US008989419B2

(12) United States Patent
Graber et al.

(10) Patent No.: US 8,989,419 B2
(45) Date of Patent: Mar. 24, 2015

(54) PHASE PLUG WITH AXIALLY TWISTED RADIAL CHANNELS

(75) Inventors: Curtis E. Graber, Woodburn, IN (US); Barry Allen Richart, New Haven, IN (US)

(73) Assignee: Curtis E. Graber, Woodburn, IN (US)

( * ) Notice: Subject to any disclaimer, the term of this patent is extended or adjusted under 35 U.S.C. 154(b) by 73 days.

(21) Appl. No.: 13/352,996

(22) Filed: Jan. 18, 2012

(65) Prior Publication Data

US 2013/0182879 A1 Jul. 18, 2013

(51) Int. Cl.
*H04R 1/20* (2006.01)
*H04R 1/34* (2006.01)

(52) U.S. Cl.
CPC ..... *H04R 1/345* (2013.01); *H04R 2201/34* (2013.01)
USPC ..... 381/343; 381/339; 381/340

(58) Field of Classification Search
CPC ..... H04R 1/30; H04R 1/345; H04R 1/347; H04R 2201/24
USPC ..... 381/343, 337, 339, 340; 181/177, 152, 181/159
See application file for complete search history.

(56) References Cited

U.S. PATENT DOCUMENTS

| | | | | |
|---|---|---|---|---|
| 2,037,187 | A | 4/1936 | Wente | |
| 3,664,455 | A | 5/1972 | Duvvuri | |
| 4,050,541 | A | 9/1977 | Henricksen | |
| 4,157,741 | A | 6/1979 | Goldwater | |
| 5,117,462 | A | 5/1992 | Bie | |
| 5,672,047 | A | 9/1997 | Birkholz | |
| 6,064,745 | A * | 5/2000 | Avera | 381/343 |
| 6,952,874 | B2 | 10/2005 | Button et al. | |
| 7,095,868 | B2 | 8/2006 | Geddes | |
| 7,708,112 | B2 | 5/2010 | Geddes | |
| 8,121,316 | B2 * | 2/2012 | Dodd | 381/186 |
| 2006/0034475 | A1 | 2/2006 | Geddes | |
| 2008/0192972 | A1 * | 8/2008 | Lewallen | 381/343 |
| 2012/0033841 | A1 * | 2/2012 | Donarski | 381/340 |

* cited by examiner

*Primary Examiner* — Davetta W Goins
*Assistant Examiner* — Oyesola C Ojo
(74) *Attorney, Agent, or Firm* — Taylor IP, P.C.

(57) ABSTRACT

A loudspeaker assembly comprises a casing with a diaphragm loudspeaker mounted in the casing. A phase plug is mounted in the casing adjacent the diaphragm loudspeaker. The phase plug has a central cone with a longitudinal axis extending from an input end adjacent the diaphragm loudspeaker to an output end with its base at the input end tapering to an apex at the output end. A plurality of vanes extend radially outwardly from the central cone with the plurality of vanes being thickest at the input end and progressively thinning toward the output end. Radially outward edges of the plurality of vanes are twisted relative to the longitudinal axis with the degree of twist being progressively greater with increasing proximity to the output end. The plurality of vanes tapers in width along their longitudinal extent from the input end to the output end.

9 Claims, 10 Drawing Sheets

PHASE PLUG WITH AXIALLY TWISTED RADIAL CHANNELS

BACKGROUND

1. Technical Field

The field relates to acoustic phase plugs.

2. Description of the Problem

Horn loading a diaphragm type loudspeaker has long been done in order to control the direction of radiation of sound produced. A horn also increases loudspeaker efficiency in air as it operates as a transformer to improve impedance matching between the loudspeaker and the transmission medium. In effect, a horn makes the air adjacent the loudspeaker diaphragm "stiffer." It was also early recognized that horns progressively cut-off the throughput of middle and high frequency sound with increasing frequency and, consequentially, operate to distort voices and music. Wente in U.S. Pat. No. 2,037,187 noted that the cutoff characteristic was traceable in a large measure to the fact that the sound waves emanating from the various portions of the diaphragm of the loudspeaker traverse paths of unequal length before reaching the throat of the horn. As a result sound waves propagated from different areas of the diaphragm reach the throat out of phase. For low frequency waves the disparity in phase is not particularly detrimental but at progressively higher frequencies the phase difference can increase to a sufficient degree to cause a marked neutralization (or cancellation) of the sound waves with high frequency speech and music being noticeably diminished in intensity. Horn performance was improved by making the sound front introduced to the throat of the horn increasingly "planar."

Wente proposed a "sound translating device," or what today would be called a phase plug, to control path distance between sections of a loudspeaker diaphragm and a horn throat. The phase plug was constructed using a tapered cone and a plurality of progressively larger, hollow tapered members with the tapered cone nested in the smallest hollow tapered member and the smallest hollow tapered member nested in the next smallest member to produce a series of annular air ducts/sound channels intermediate a dome shaped portion of the diaphragm and the horn throat.

Henricksen in U.S. Pat. No. 4,050,541 proposed a phase plug having radial rather than annular sound channels. This was done in part to simplify manufacture of the phase plug. Avera in U.S. Pat. No. 6,064,745 taught a phase plug with radial channels where the phase plug had a frusto-conical body with a spherical entrance face which conformed to a loudspeaker diaphragm and a planar outlet face. The channels through the plug exhibited equal or slowly increasing aperture area from entrance face to outlet face to minimize diffraction.

Whether employed with a horn/waveguide or not, generation of a sound field characterized by planar wavefronts from a diaphragm type loudspeaker reduces distortion at a point of reception, particularly at high frequencies. A wavefront is usually defined as a surface of constant phase. The further characterization of a wavefront as being "planar" means that the sound field exhibits constant phase in a flat surface where the surface is perpendicular to the direction of sound propagation. A sound field can consist of successive planar wavefronts.

SUMMARY

A loudspeaker assembly comprises a casing with a diaphragm loudspeaker mounted in the casing. A phase plug is mounted in the casing adjacent the diaphragm loudspeaker. The phase plug has a central cone with a longitudinal axis extending from an input end adjacent the diaphragm loudspeaker to an output end with its base at the input end tapering to an apex at the output end. A plurality of vanes extend radially outwardly from the central cone with the plurality of vanes being thickest at the input end and progressively thinning toward the output end. Radially outward edges of the plurality of vanes are twisted relative to the longitudinal axis with the degree of twist being progressively greater with increasing proximity to the output end. The plurality of vanes tapers in width along their longitudinal extent from the input end to the output end. The casing, plurality of vanes, central cone and interior walls define a plurality of radially twisted phase leveling channels having input ports on the input end and outlet ports on the output end of the phase plug.

BRIEF DESCRIPTION OF THE DRAWINGS

Understanding of the following description may be enhanced by reference to the accompanying drawings, wherein.

DETAILED DESCRIPTION

Figure 1:
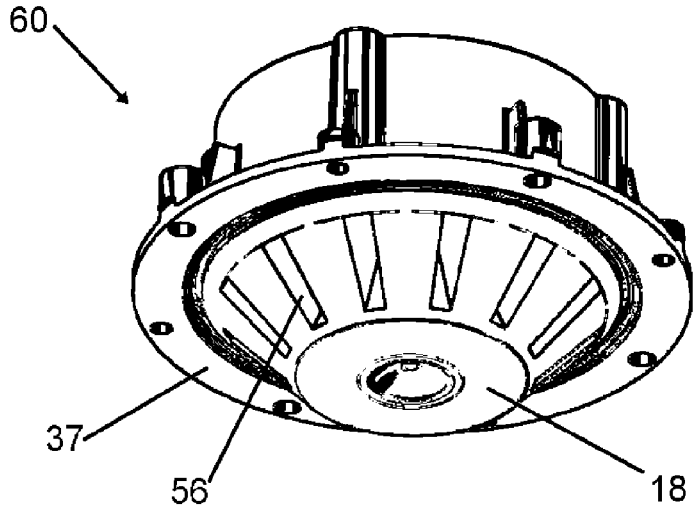
FIG. 1 is a bottom or input end perspective view of a phase plug assembly.
Figure 2:
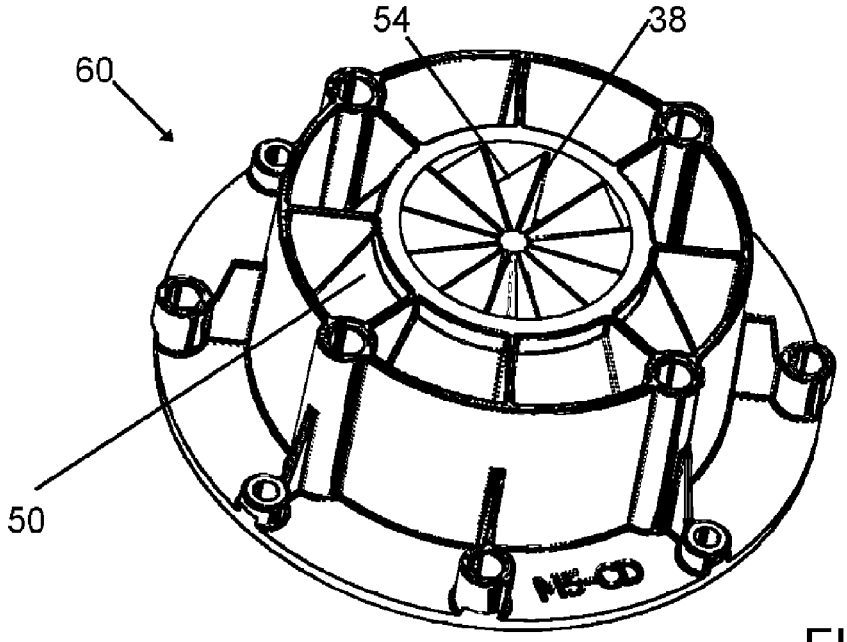
FIG. 2 is an output end perspective view of the phase plug assembly of FIG. 1.
Figure 3:
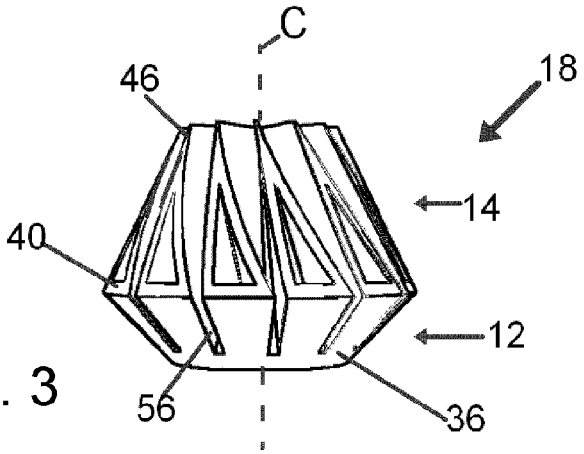
FIG. 3 is a plan view of the phase plug from the phase plug assembly of FIGS. 1 and 2.
Figure 4:
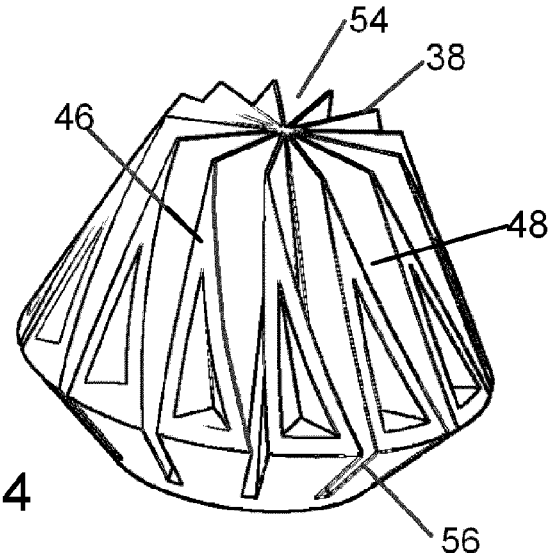
FIG. 4 is a perspective view of the phase plug.
Figure 5:
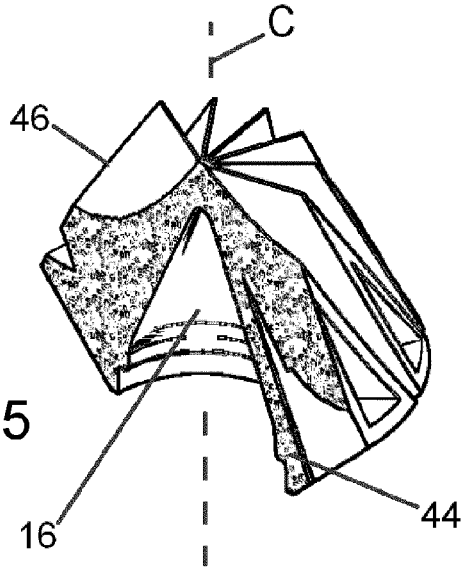
FIG. 5 is a cutaway view of the phase plug.
Figure 6:
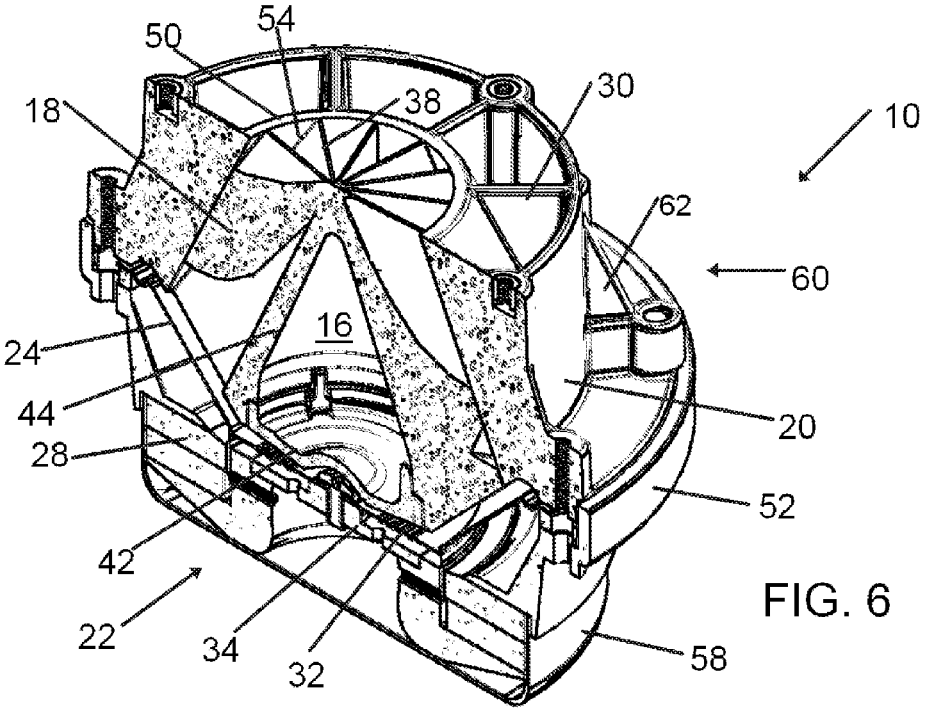
FIG. 6 is a perspective cutaway view of a loudspeaker assembly incorporating a phase plug.
Figure 7:
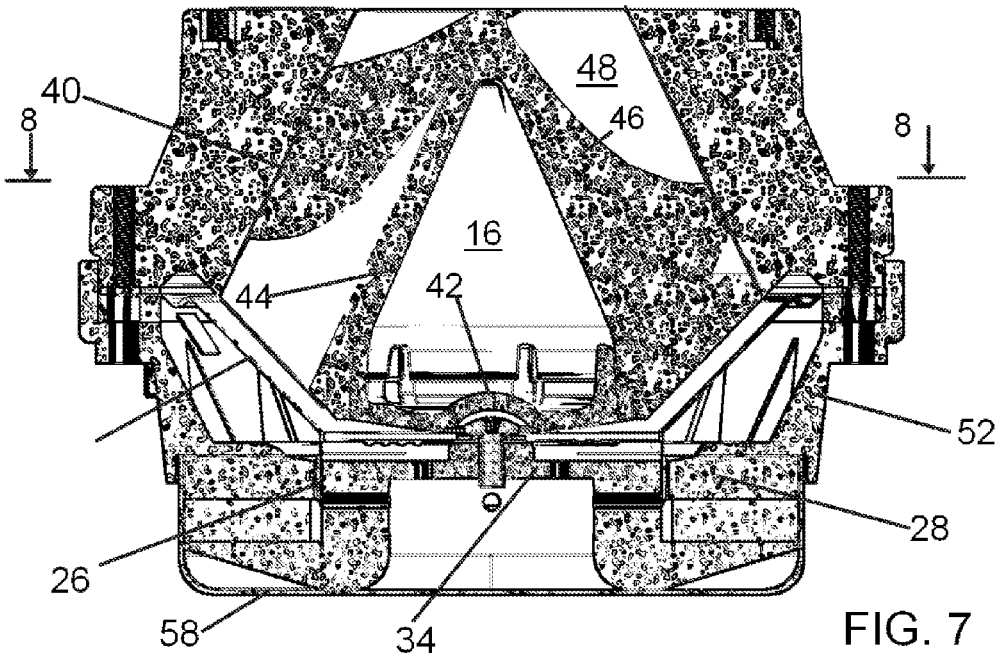
FIG. 7 is a side elevation of the phase plug.
Figure 8:
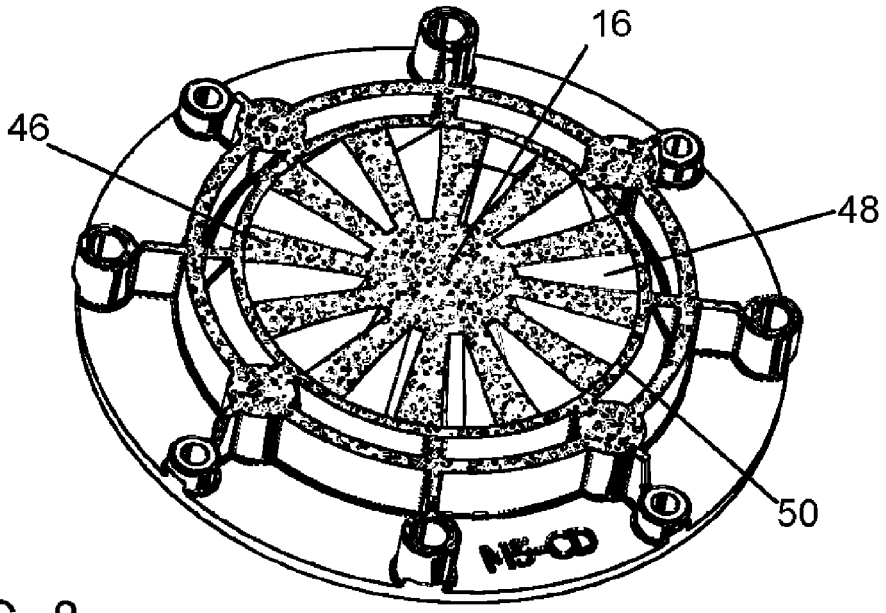
FIG. 8 is a sectioned view of the phase plug assembly taken perpendicular to its longitudinal axis along section lines 8-8 in FIG. 7.
Figure 9:
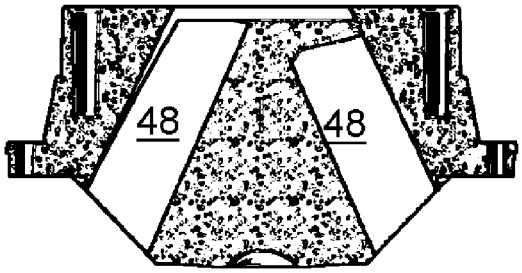
FIG. 9 is a cross sectional view of the phase plug assembly taken through the longitudinal axis of the phase plug assembly.

Referring to FIGS. 1-9 a loudspeaker assembly 10 comprises an acoustic transducer assembly 22, a phase plug sub-assembly 62 and an assembly ring 52. The acoustic transducer assembly 22 and the phase plug sub-assembly 60 are attached to opposite sides of the assembly ring 52. Loudspeaker assembly 10 generates acoustic planar wavefronts from an assembly output face 38.

The phase plug sub-assembly 60 includes a carrier 62 which is a single piece molded element. Carrier 62 has a substantially cylindrical outer wall 20 attached to a circumferential assembly ring 52 at one end of the cylinder. Carrier 62 also has a frusto-conical inner casing 50 and a plurality of radial segmented divider ribs 30 formed between the cylindrical outer wall 20 and the frusto-conical inner casing. The frusto-conical inner casing 50 is hollow and defines a frusto-conical void in which the perimeter face 40 of a downstream or output section 14 of a phase plug 18 snugly fits to form a phase plug sub-assembly 60.

Frusto-conical inner casing 50 is open at both ends along the longitudinal axis C of the casing or the phase plug 18. One end opens onto output face 38 to provide planar output ports 54 which extend radially outwardly from a central longitudinal axis "C". The other end 37, surrounding an input surface 36 of the phase plug 18, is mated to assembly ring 52 and closed by the acoustic transducer assembly 22. A phase plug 18 input section 12 extends from the enclosed open end of the frusto-conical casing 50 where it is encircled by assembly ring 52. Planar output ports 54 may feed into the throat of a horn (not shown) or left exposed depending upon the application.

Phase plug 18 has a central cone 44 which is symmetric about central longitudinal axis C. Central cone 44 tapers to an apex on the output face 38. A plurality of radial vanes 46 extend radially outwardly from the central cone 44. Each radial vane 46 is thickest along an acoustically upstream or input surface 36 (see FIGS. 2 and 3), extends from the input surface 36 to the planar output face 38 and progressively thins from the input surface 36 to an edge along planar output face 38. The plurality of radial vanes 46 are twisted relative to the central longitudinal axis C with the degree of twist greatest toward the outside perimeter 40 of the output section 14. The degree of twist grows progressively larger with increasing proximity to the planar output face 38.

The inner casing 50, the plurality of radial vanes 46 and central cone 44 define a plurality of radially twisted, phase leveling channels 48 having input ports on the input end and outlet ports on the output end of the phase plug 18. The plurality of radially twisted, phase leveling channels 48 exhibit the same progressive radial twist exhibited by the vanes 46 toward the output face 38 and away from the central cone 44. The progressive thinning of the plurality of vanes 46 results in increasing latitudinal cross-sectional area of the phase leveling channels 48 at the outlet ports 54 along the planar output face 38 as compared to the inlet ports 56 on the acoustically upstream input surface 36. The distance or radius of the channels 48 progressively decreases moving downstream so that the cross-sectional area of the channels can be kept constant or allowed to slowly increase.

Phase leveling channels 48 exhibit greater minimum distances from the radially outward portions of the cone diaphragm 24 to the planar output face 38 than they exhibit relative to portions of the cone diaphragm closer to the central longitudinal axis C. The degree of twist applied to radial vanes 46 is chosen so that the minimum distance through the phase leveling channels 48 to the planar output face 38 is the same across the device.

The base phase plug 18 comprises the input surface 36 and a central base cap 42. Base cap 42 closes an anti-resonant cavity 16 within central cone 44. Taken together, input surface 36 and base cap 42 provide a surface which closely conforms to the shape of a cone diaphragm 24 which it faces and which it is proximate to. In this context the term proximate may be taken distances relative to the wavelengths of sound of interest.

Cone diaphragm 24 is a vibratile surface generating sound energy in response to electrical signals applied to a voice coil 26. The central portion of the cone diaphragm 24 is reinforced using an inverted spider support 32. Voice coil 26 is wound on a central pole mount 34 supporting the cone diaphragm 24. Changing electrical current in voice coil 26 generates force for moving the cone diaphragm 24 by interacting with the magnetic field from a permanent magnet 28 mounted outside of the voice coil on the inside wall of the steel magnetic shield bucket 58.

Figure 10:
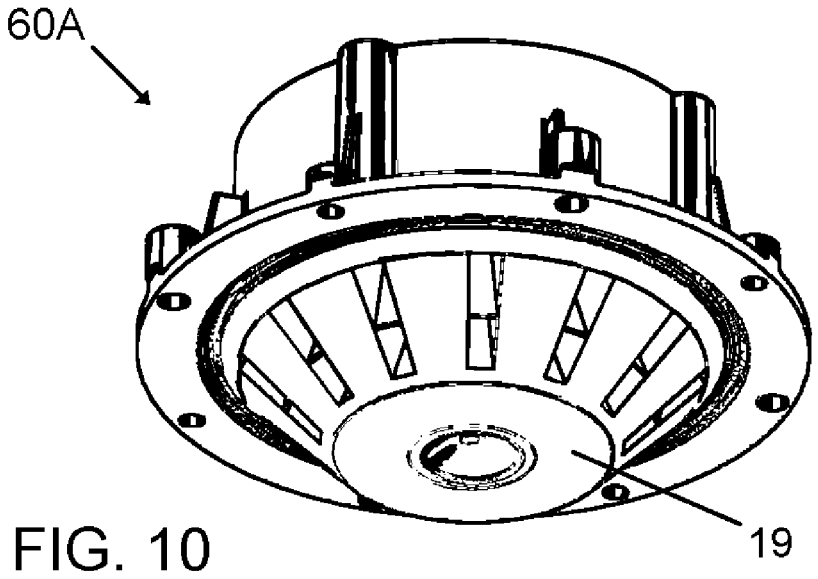
FIG. 10 is a bottom or input end perspective view of an alternative phase plug assembly.
Figure 11:
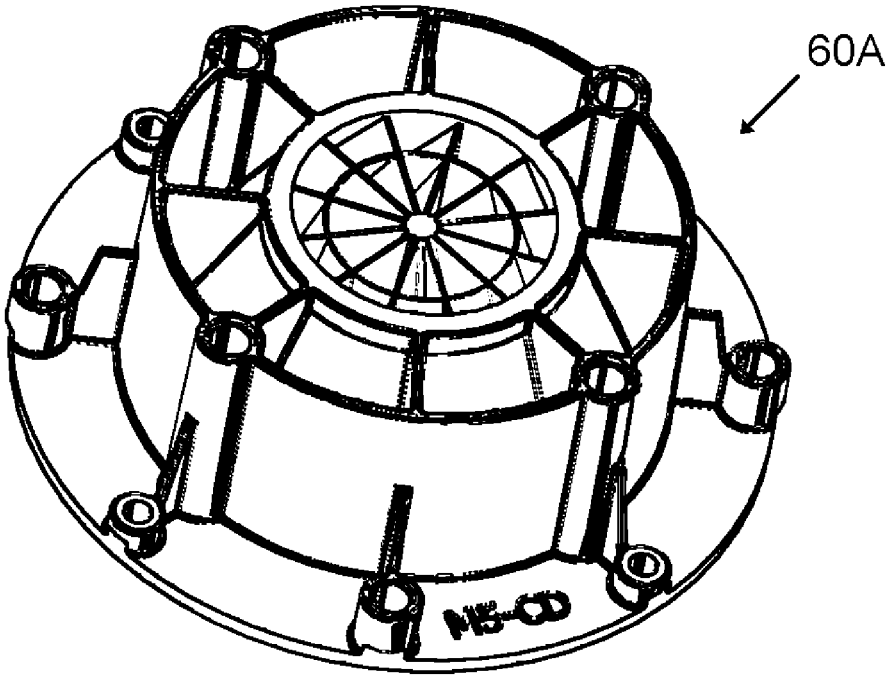
FIG. 11 is an output end perspective view of the phase plug assembly of FIG. 10.
Figure 12:
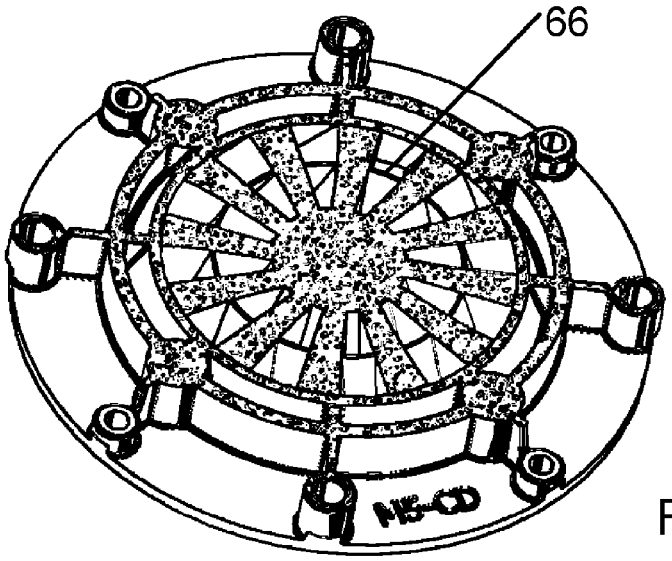
FIG. 12 is a sectioned view of the alternative phase plug assembly taken perpendicular to its longitudinal axis.
Figure 13:
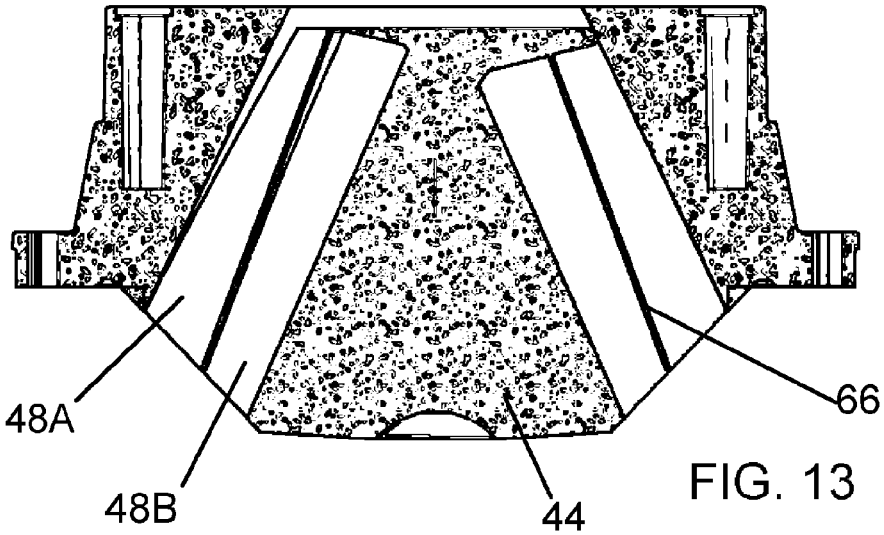
FIG. 13 is a cross sectional view of the phase plug assembly taken through the longitudinal axis of the phase plug assembly.
Figure 16:
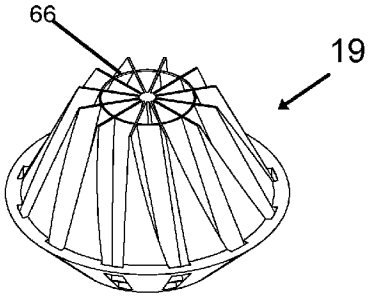
FIG. 16 is a perspective view from the output end of the alternative phase plug.
Figure 15:
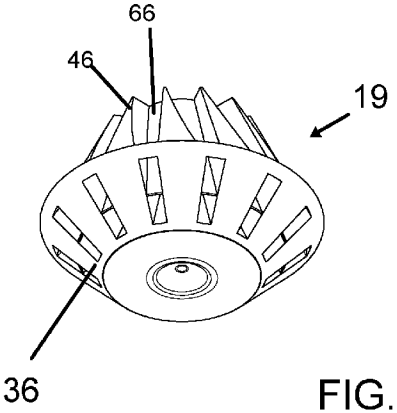
FIG. 15 is an input end perspective view of the alternative phase plug.
Figure 17:
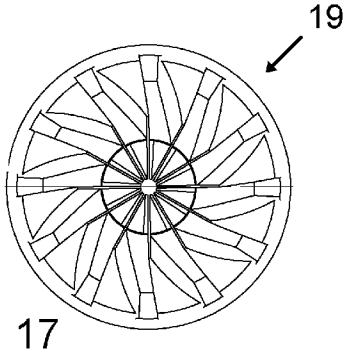
FIG. 17 is a plan view of the input end of the alternative phase plug.
Figure 14:
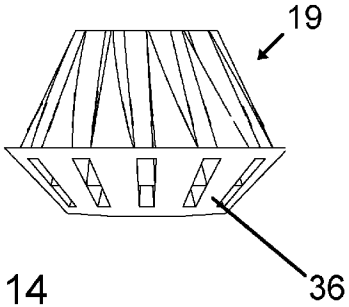
FIG. 14 is a side elevation of the phase plug of the alternative phase plug assembly.

Referring to FIGS. 10-17 an alternative phase plug assembly 60A is illustrated. Phase plug assembly 60A is substantially identical to phase plug assembly 60 except that the phase plug 19 incorporates an annular dividing ring 66 which divides the twisted radial channels 48 into radially inner and outer divisions 48A and 48B, respectively. The annular dividing ring 66 has a constant width and parallels the taper of the outer surface of the central cone 44.

Figure 18:
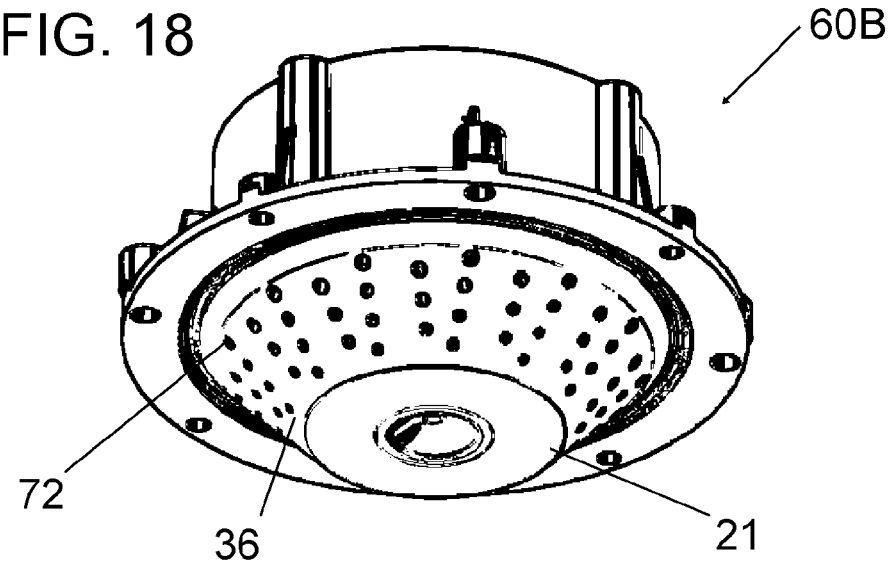
FIG. 18 is a bottom or input end perspective view of a second alternative phase plug assembly.
Figure 19:
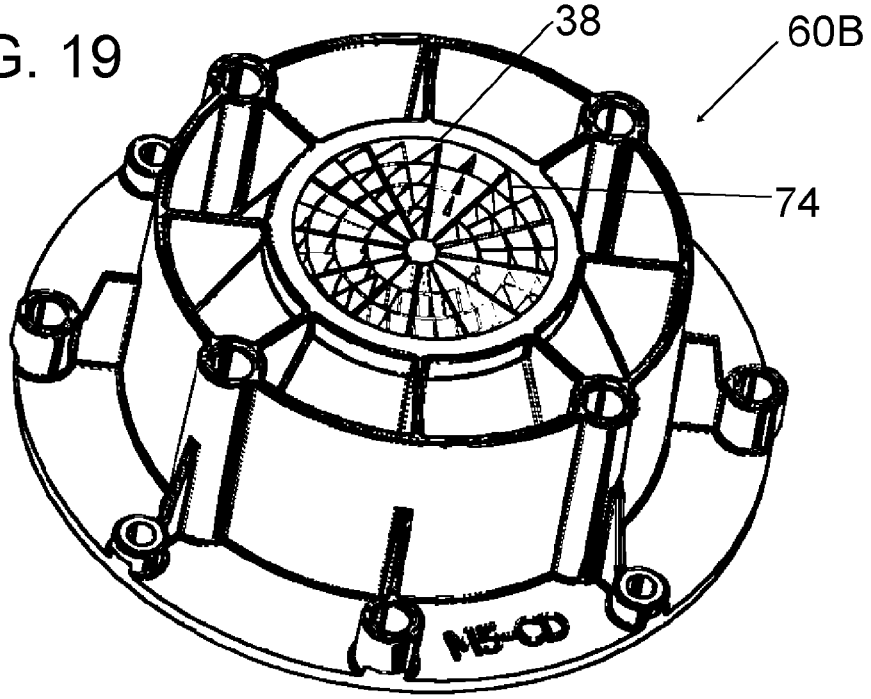
FIG. 19 is an output end perspective view of the phase plug assembly of FIG. 18.
Figure 20:
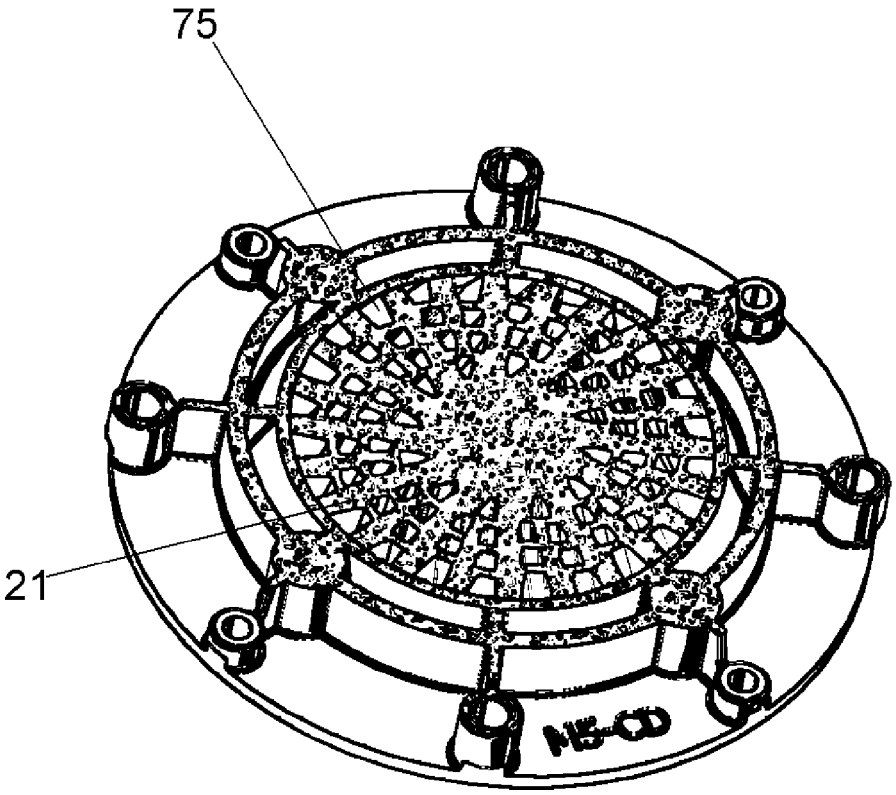
FIG. 20 is a sectioned view of the second alternative phase plug assembly taken perpendicular to its longitudinal axis.
Figure 21:
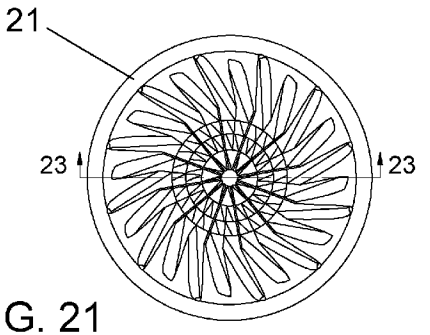
FIG. 21 is an end view of the second alternative phase plug.
Figure 22:
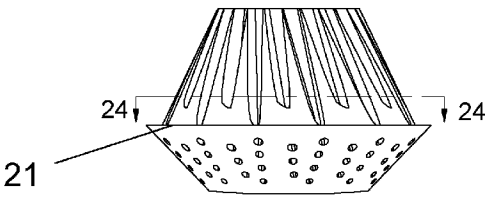
FIG. 22 is a side elevation of the second alternative phase plug.
Figure 23:
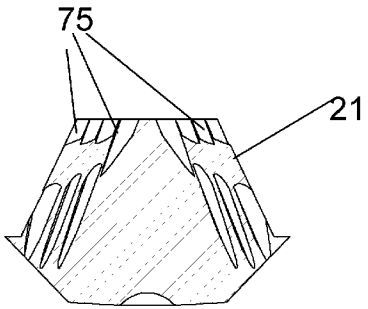
FIG. 23 is a cross section taken along section lines 23-23 of FIG. 21.
Figure 25:
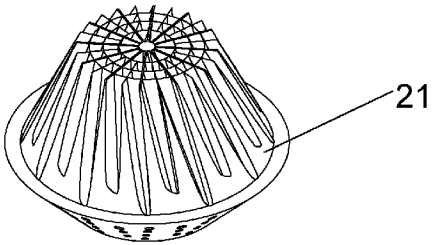
FIG. 25 is a perspective view of the output end of the second alternative phase plug.
Figure 24:
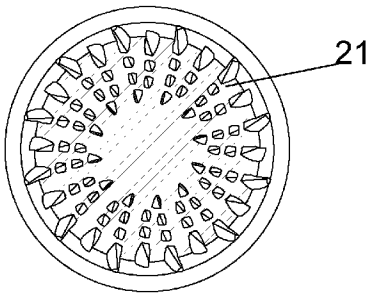
FIG. 24 is a cross section taken along section lines 24-24 of FIG. 22.
Figure 26:
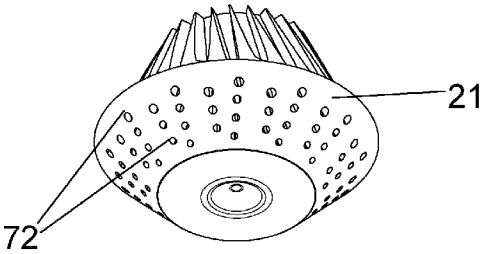
FIG. 26 is a reverse angle perspective view to that of FIG. 25.

Referring to FIGS. 18-26 still another phase plug assembly 60B is illustrated which is structurally the same as phase plug assembly 60 except for substitution of a alternative phase plug 21. Phase plug 21 displays a largely closed input surface 36 broken by concentric ring constellations of a plurality of input ports 72. Input ports 72 are connected by radially twisted channels 75 which run through the body of phase plug 21 to connect with outlet ports 74 on the output surface 38 of the phase plug assembly 60B.

For any given cross section taken perpendicular to the central longitudinal axis of phase plug 21, the channels 75 are arranged in concentric circular constellations around the axis. The radius of each constellation grows progressively smaller moving acoustically downstream through the phase plug 21. Channels 75 may increase in cross sectional area from the input port 72 toward the output port 74 for each channel so that the surface area of output surface 38 is largely made up of output ports 74.

What is claimed is:

1. A phase plug comprising:

a body having a longitudinal axis and a latitudinal perimeter which is symmetric about the longitudinal axis;

an upstream surface to the body which conforms in shape with a loudspeaker cone diaphragm to allow the upstream surface to be placed proximate to the loudspeaker cone diaphragm;

a plurality of inlets through the upstream surface disposed symmetrically about and having an outward radial orientation on the longitudinal axis;

a downstream planar output plane substantially perpendicular to the longitudinal axis, the downstream planar output plane being divided into a plurality of outlet ports in one to one correspondence to the plurality of inlets; and phase leveling channels connecting each of the plurality of inlets to a particular one of the plurality of outlets, each phase leveling channel exhibiting a continuously growing progressive radial twist increasing from minimums along the upstream surface and along radially interior sections to maximums at the downstream planar output surface and along a latitudinal perimeter of the body.

2. The phase plug as claimed in claim 1, further comprising: the growing progressive radial twist is smooth moving downstream along the longitudinal axis and radially outwardly.

3. The phase plug as claimed in claim 2, further comprising:

a conical core having a central axis, a downstream end and an upstream end with an apex at the downstream end with the conical core defining the radially interior sections of the phase leveling channels;

a plurality of vanes extending radially from the core to define the phase leveling channels, the vanes being thickest at the upstream end and progressively thinning toward the downstream end; and the plurality of vanes being twisted on the core, the degree of twist increasing moving from the upstream to the downstream end.

4. A loudspeaker assembly comprising:

a casing;

a diaphragm loudspeaker mounted in the casing;

a phase plug mounted in the casing adjacent the diaphragm loudspeaker, the phase plug having a central cone with a longitudinal axis extending from an input end adjacent the diaphragm loudspeaker to an output end with a base at the input end tapering to an apex at the output end;

a plurality of vanes extending radially outwardly from the central cone, the plurality of vanes being thickest at the input end and continuously progressively thinning toward the output end; and radially outward edges of the plurality of vanes being twisted relative to the longitudinal axis with the degree of twist being continuously progressively greater with increasing proximity to the output end.

5. The loudspeaker assembly as claimed in claim 4, further comprising: the plurality of vanes tapering in width along their longitudinal extent from the input end to the output end.

6. The loudspeaker assembly as claimed in claim 5, further comprising: the casing, plurality of vanes and central cone defining along interior walls a plurality of phase leveling channels having input ports on the input end and outlet ports on the output end of the phase plug.

7. The loudspeaker assembly as claimed in claim 6, further comprising: the inlet ports extending radially outwardly from the base of the central cone.

8. A phase plug comprising:

a central cone with a longitudinal axis extending from an input end to an output end with a base at the input end tapering to an apex at the output end;

a plurality of vanes extending radially outwardly from the central cone, the plurality of vanes being thickest at the input end and continuously progressively thinning toward the output end; and radially outward edges of the plurality of vanes being twisted relative to the longitudinal axis with the degree of twist being progressively greater with increasing proximity to the output end.

9. The phase plug as claimed in claim 8, further comprising: the plurality of vanes tapering in width along their longitudinal extent from the input end to the output end.

* * * * *